US007310938B2

(12) United States Patent
Marcum et al.

(10) Patent No.: US 7,310,938 B2
(45) Date of Patent: Dec. 25, 2007

(54) COOLED GAS TURBINE TRANSITION DUCT

(75) Inventors: Steven Marcum, Rockledge, FL (US); David Alan Gill, Juno Beach, FL (US); Kenneth Slentz, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 315 days.

(21) Appl. No.: 11/014,294

(22) Filed: Dec. 16, 2004

(65) Prior Publication Data

US 2006/0130484 A1 Jun. 22, 2006

(51) Int. Cl.
*F23R 3/42* (2006.01)

(52) U.S. Cl. ..... 60/39.37; 60/752

(58) Field of Classification Search ..... 60/752, 60/39.37

See application file for complete search history.

(56) References Cited

U.S. PATENT DOCUMENTS

| | | | | |
|---|---|---|---|---|
| 4,195,474 | A | 4/1980 | Bintz et al. | |
| 4,465,284 | A | 8/1984 | Szema | |
| 4,719,748 | A * | 1/1988 | Davis et al. | 60/39.37 |
| 4,903,477 | A | 2/1990 | Butt | |
| 5,237,813 | A | 8/1993 | Harris et al. | |
| 5,906,093 | A | 5/1999 | Coslow et al. | |
| 6,018,950 | A * | 2/2000 | Moeller | 60/752 |
| 6,116,013 | A | 9/2000 | Moller | |
| 6,197,424 | B1 * | 3/2001 | Morrison et al. | 428/402 |
| 6,282,905 | B1 * | 9/2001 | Sato et al. | 60/752 |
| 6,298,656 | B1 | 10/2001 | Donovan et al. | |
| 6,412,268 | B1 | 7/2002 | Cromer et al. | |
| 6,494,044 | B1 | 12/2002 | Bland | |
| 7,010,921 | B2 * | 3/2006 | Intile et al. | 60/752 |
| 7,047,723 | B2 * | 5/2006 | Martling et al. | 60/39.37 |
| 7,137,241 | B2 * | 11/2006 | Martling et al. | 60/39.37 |
| 2003/0106317 | A1 | 6/2003 | Jorgensen et al. | |
| 2003/0106318 | A1 | 6/2003 | Leahy, Jr. | |
| 2003/0204944 | A1 | 11/2003 | Norek | |

FOREIGN PATENT DOCUMENTS

| | | | |
|---|---|---|---|
| GB | 2087066 | * | 5/1982 |
| JP | 63-143422 | * | 6/1988 |
| JP | 2003-286863 | * | 10/2003 |

* cited by examiner

*Primary Examiner*—Ted Kim

(57) ABSTRACT

A transition duct (40) for a gas turbine engine (10) incorporating a combination of cooling structures that provide active cooling in selected regions of the duct while avoiding cooling of highly stressed regions of the duct. In one embodiment, a panel (74) formed as part of the transition duct includes some subsurface cooling holes (92) that extend under a central portion of a stiffening rib (90) attached to the panel and some subsurface cooling holes (94) that have a truncated length so as to avoid extending under a rib end (45). Effusion cooling holes (88) used to cool a side subpanel (48) of the panel may have a distribution that reduces to zero approaching a double bend region (48) of the panel. An upstream subpanel (76) of the panel may be actively cooled only when the panel is located on an extrados of the transition duct.

8 Claims, 3 Drawing Sheets

COOLED GAS TURBINE TRANSITION DUCT

FIELD OF THE INVENTION

This invention relates generally to the field of gas (combustion) turbine engines, and more particularly, to a transition duct conveying hot combustion gas from a combustor to a turbine section of a gas turbine engine.

BACKGROUND OF THE INVENTION

A typical can-annular gas turbine engine 10 such as manufactured by the assignee of the present invention is illustrated in partial cross-sectional view in FIG. 1. The engine 10 includes a plurality of combustors 12 (only one illustrated) arranged in an annular array about a rotatable shaft 14. The combustors 12 receive a combustible fuel from a fuel supply 16 and compressed air from a compressor 20 that is driven by the shaft 14. The fuel is combusted in the compressed air within the combustors 12 to produce hot combustion gas 22. The combustion gas 22 is expanded through a turbine 24 to produce work for driving the shaft 14. The shaft 14 may also be connected to an electrical generator (not illustrated) for producing electricity.

The hot combustion gas 22 is conveyed from the combustors 12 to the turbine 24 by a respective plurality of transition ducts 26. The transition ducts 26 each have a generally cylindrical shape at an inlet end 28 corresponding to the shape of the combustor 12. The transition ducts 26 each have a generally rectangular shape at an outlet end 30 corresponding to a respective arc-length of an inlet to the turbine 24. The plane of the inlet end 28 and the plane of the outlet end 30 are typically disposed at an angle relative to each other. The degree of curvature of the radially opposed sides of the generally rectangular outlet end 30 depends upon the number of transition ducts 26 used in the engine 10. For example, in a Model 501 gas turbine engine supplied by the assignee of the present invention, there are sixteen combustors 12 and transition ducts 26, thus each transition duct outlet end 30 extends across a 22.5° arc of the turbine inlet. A Model 251 engine supplied by the present assignee utilizes only eight combustors 12 and transition ducts 26, thus each transition duct outlet end 30 extends across approximately a 45° arc.

The high firing temperatures generated in a gas turbine engine combined with the complex geometry of the transition duct 26 can lead to a temperature-limiting level of stress within the transition duct 26. Materials capable of withstanding extended high temperature operation are used to manufacture transition ducts 26, and ceramic thermal barrier coatings may be applied to the base material to provide additional protection. Active cooling of the transition duct 26 with either air or steam may be used. Steam cooling is provided by routing steam from an external source through internal cooling passages formed in the transition duct 26. Air cooling may be provided by utilizing the compressed air flowing past the transition duct 26 between the compressor and the combustor or from another source. Cooling air may be routed through cooling passages formed in the transition duct 26, or it may be impinged onto the outside (cooled) surface of the transition duct 26, or it may be allowed to pass through holes from the outside of the transition duct 26 to the inside provide a barrier layer of cooler air between the combustion air and the duct wall (effusion cooling). Further details regarding such cooling schemes may be found in U.S. Pat. No. 5,906,093, which describes a method of converting a steam-cooled transition duct to air-cooling, and United States patent application publication US 2003/0106317 A1, which describes an effusion cooled transition duct. Both of these documents are hereby incorporated by reference in their entirety.

BRIEF DESCRIPTION OF THE DRAWINGS

The advantages of the present invention will be more apparent from the following description in view of the drawings that show.

DETAILED DESCRIPTION OF THE INVENTION

Model 251 gas turbine engines manufactured by the assignee of the present invention currently rely on a ceramic thermal barrier coating to limit the temperature of the material used to form the transition ducts. Refinements in the combustor design for this style of engine have increased the operating temperature of the transition ducts, thereby providing incentive for improvements in the cooling of the duct wall material.

Figure 1:
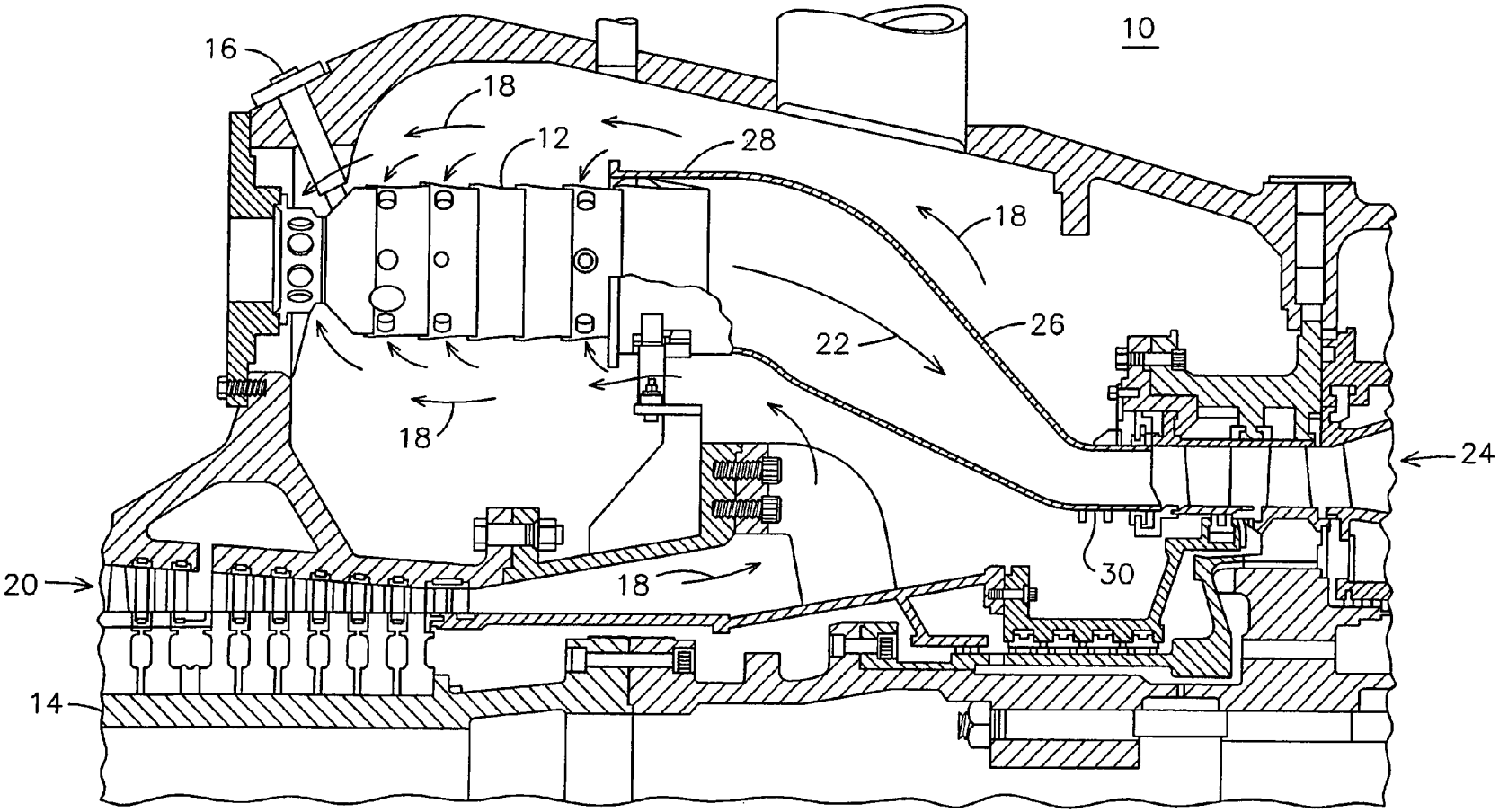
FIG. 1 PRIOR ART
FIG. 1 is a partial cross-sectional view of a prior art gas turbine engine.
Figure 2:
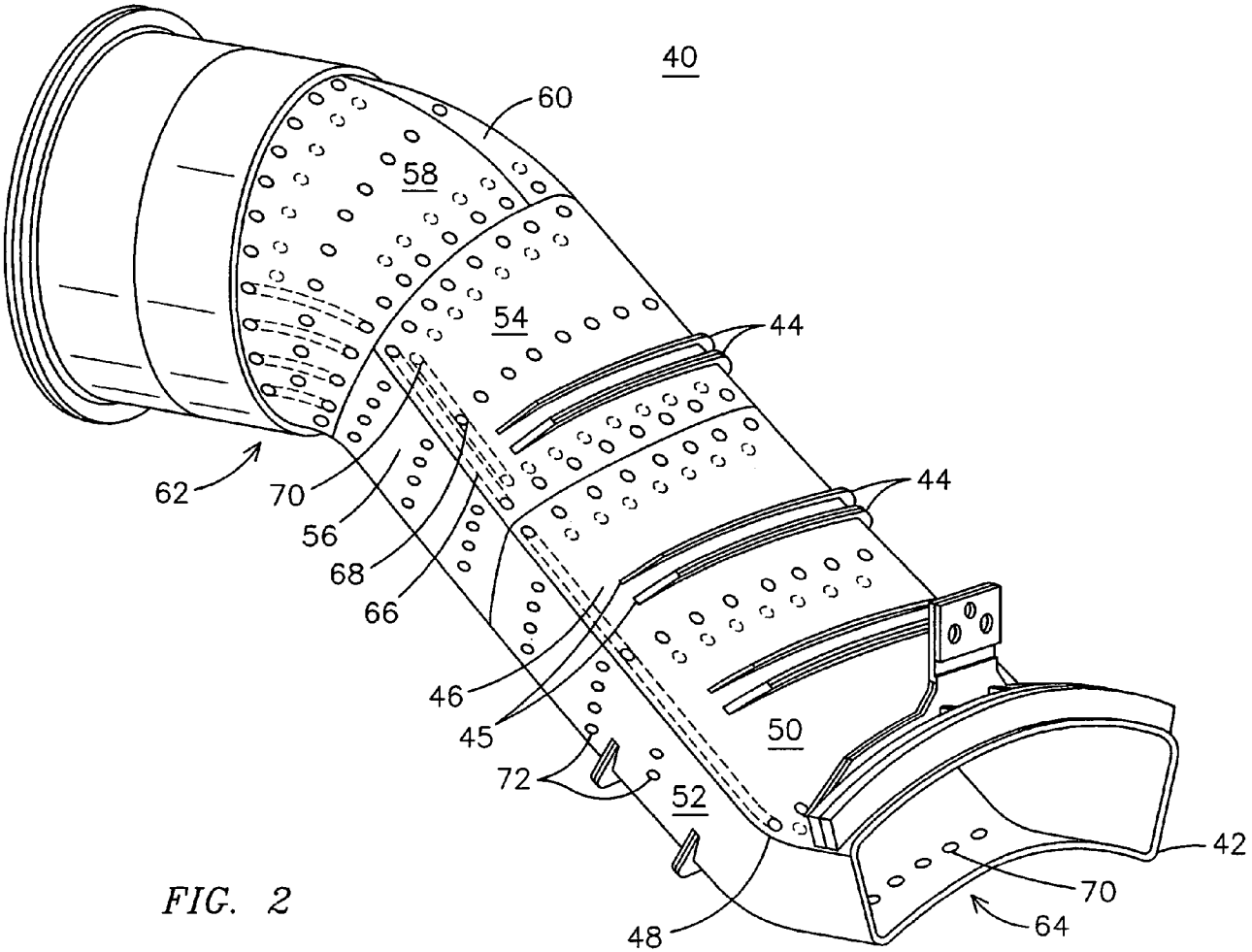
FIG. 2 is a perspective view of a transition duct for a gas turbine engine.

FIG. 2 is a perspective view of an improved transition duct 40 that may be used in a gas turbine engine such as a Model 251 engine, for example. This transition duct 40 innovatively combines strategically placed internal cooling channels and effusion cooling holes with selected areas of no active cooling to obtain an improved level of performance when compared to prior art designs.

Transition duct 40 is formed from a plurality of individual panels 50, 52, 54, 56, 58, 60. The panels are formed to a desired shape and then are joined such as by welding to define the desired duct shape transitioning from a generally circular inlet end 62 defining an inlet end plane to a generally rectangular outlet end 64 defining an outlet end plane disposed at an angle relative to the inlet end plane. The outlet end 64 is disposed radially inwardly of the inlet end 62 when installed in a gas turbine engine. Individual panels may be formed to include internal cooling air passages 66 by processes known in the art. The cooling passages 66 have one or more inlet openings 68 extending to an outside surface of the duct 40 for receiving compressed air from the compressor (not shown) and one or more outlet openings 70 extending to the inside surface of the duct 40 for discharging the heated compressed air into the flow of hot combustion gas passing through the duct 40. The individual panels may further be formed to include effusion cooling holes 72 extending from the duct outside surface to the duct inside surface for passing compressed air directly through the duct wall without passing through an internally extending cooling passage. Each cooling hole 72 may be formed along an axis that is perpendicular to the duct wall surface; alternatively, some or all of the cooling holes 72 may be formed at an angle oblique to the surface.

In gas turbine engines having only eight combustors per engine, the duct outlet mouth 42 must extend across approximately a 45° arc portion of the turbine inlet. This relatively large size of duct will have a lower degree of rigidity when compared to the ducts in engine designs requiring an arc span of only half that amount. As a result, a plurality of stiffening ribs 44 are attached to the outside surface of the respective panels 50, 54 to provide an added degree of stiffness to the structure. Such stiffening ribs 44 may be required for other transition duct designs having an outlet end mouth spanning at least approximately a 45° arc of a turbine inlet. Although useful in stiffening the overall structure, these ribs 44 create a stress field concentration within the duct wall 46 proximate each opposed end 45 of the respective ribs 44. The level of stress in this region is further increased because the ribs 44 are cooled by the surrounding compressed air flow, thereby creating a stress-generating temperature differential between the rib 44 and the duct wall 46.

Another region of the transition duct 40 that is subjected to stress concentration is the double bend region 48. The double bend region 48 is defined by a stress field concentration caused by the complex geometry of this region.

The cooling scheme for transition duct 40 includes an innovative combination of cooling passages 66, effusion cooling holes 72, and regions where no active cooling is provided. The region of the duct wall 46 proximate an end 45 of a stiffening rib 44, for example within ½ inch of the rib end 45, is maintained as a region without active cooling. The region without active cooling will be relatively hotter than actively cooled regions. By reducing the temperature differential across the duct wall 46 in the region proximate a rib end 45, there is a resulting reduction in the level of stress in the duct wall 46 when compared to a similar construction incorporating active cooling proximate the rib ends 45.

Figure 3:
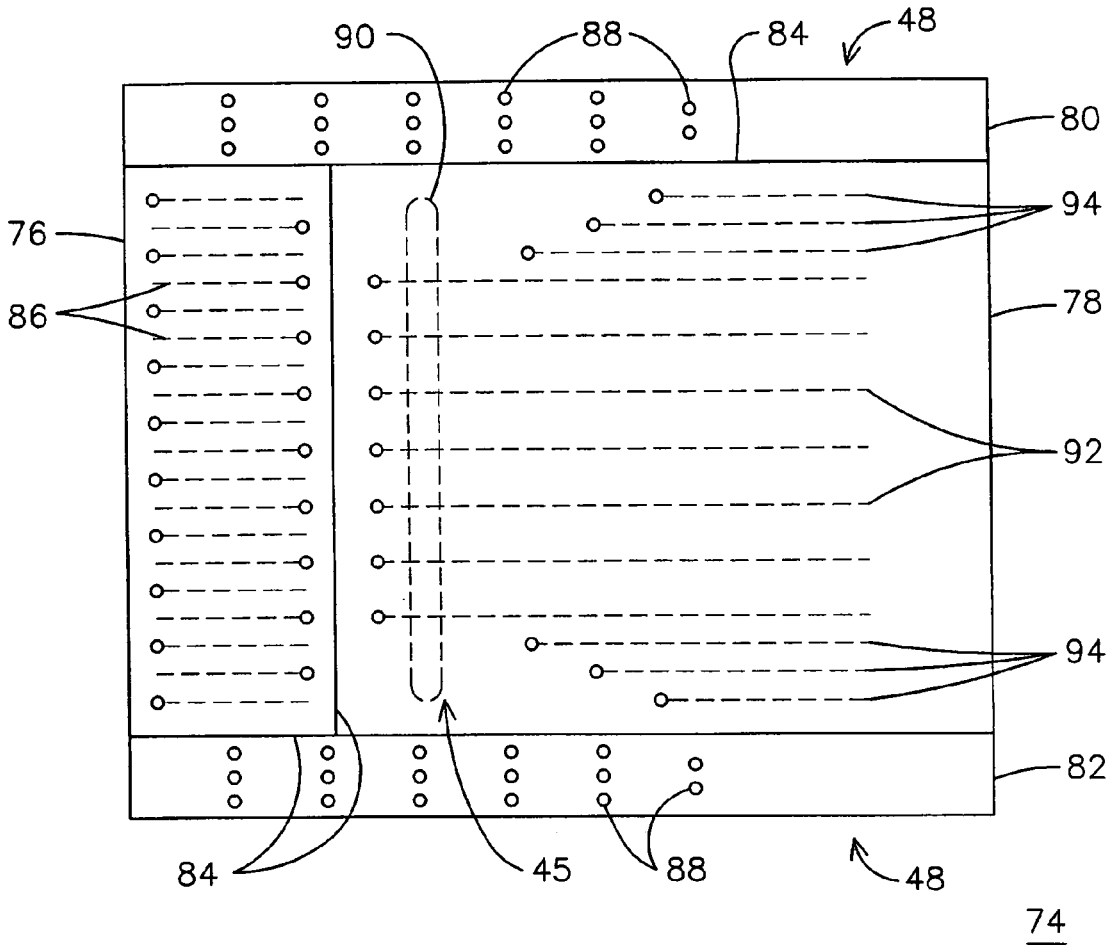
FIG. 3 is a top view of a panel used in the fabrication of a transition duct.

FIG. 3 is a top view of a panel 74 that may be used for fabricating a gas turbine transition duct. The panel 74 is illustrated at a stage of fabrication before it is welded to other panels and before it is bent to its final desired shape. A typical panel may be formed of a nickel based alloy steel such as HAYNES 230® alloy available from Haynes International, Inc. In this embodiment, panel 74 is fabricated from a plurality of subpanels, an upstream subpanel 76, a downstream subpanel 78, and two side subpanels 80, 82. The subpanels are joined together by fabrication welds prior to the panel being bent to its final desired geometry. Regions of active cooling structures and regions having no active cooling structures are formed in the panel 74. For example, for a panel to be used on a top portion (extrados) of transition duct similar to the one illustrated in FIG. 2, the upstream subpanel 76 may be formed to include a plurality of cooling passages 86. The cooling passages 86 are subsurface passages formed by any known process, such as by bonding together three layers of material with the middle layer containing slots that define the passageways, with inlet and outlet openings for the passages 86 formed by drilling holes through the respective upper or lower layer. A similar panel used on a bottom portion (intrados) of the same transition duct may be formed without active cooling structures in its upstream subpanel, since the bottom side of the duct may operate at a lower heat load due to the impingement of the hot combustion gas onto the top portion due to the bend of the duct.

Subpanels 80, 82 may be formed to include effusion cooling holes 88 that allow compressed air to pass from the outside (cooled) side of the duct wall to the inside (heated) side of the duct wall to create a layer of relatively cool air between the hot combustion gas and the duct wall. The size and distribution of the effusion holes 88 are selected to provide a desired degree of cooling. A typical effusion hole may have a 0.020" diameter and the holes may be formed in a triangular grid pattern. In one embodiment, the size and/or number of such cooling holes distributed along a length of the panel are reduced to zero approaching the region of the panel 74 that will be formed into the double bend region 48. No active cooling structure is provided in this region 48 in order to minimize the thermal stresses in this stress-limiting region.

The location of a stiffening rib to be attached to panel 74 during a later stage of fabrication is indicated in FIG. 3 by phantom outline 90. A plurality of subsurface cooling air passages 92 are formed in subpanel 78, however, selected ones 94 of the cooling air passages 92 are truncated in their respective axial lengths so that they do not extend proximate the region of rib end 45. No active cooling structure is formed proximate the region of rib end 45 in order to minimize the thermal stresses in this stress-limiting region.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A panel of a transition duct for a gas turbine engine, the panel comprising:

an upstream subpanel joined to a downstream subpanel;

side subpanels joined along respective opposed sides of the upstream panel and the downstream panel, each side subpanel comprising a double bend region of the transition duct; and cooling structures formed in each of the side subpanels in only regions remote from the respective double bend regions.

2. The panel of claim 1, further comprising a distribution of effusion cooling holes reduced from a first value to zero in a direction approaching the respective double bend regions.

3. The panel of claim 1, further comprising:

a stiffening rib comprising opposed rib ends attached to the downstream panel;

a first subsurface cooling passage formed in the downstream subpanel and extending under the stiffening rib remote from the rib ends; and a second subsurface cooling passage formed in the downstream subpanel extending toward one of the rib ends and being truncated so as not to extend under the one of the rib ends.

4. The panel of claim 1 disposed on an extrados of the transition duct, further comprising a plurality of subsurface cooling channels formed in the upstream subpanel.

5. A transition duct for conveying hot combustion gas from a combustor to a turbine in a gas turbine engine, the transition duct comprising:

a plurality of panels joined together to form a duct comprising a generally cylindrical inlet end and a generally rectangular outlet end disposed radially inwardly of the inlet end when installed in the gas turbine engine;

a double bend region formed in a first of the panels;

a stiffening rib end region in a second of the panels proximate an end of a stiffening rib joined to an outside surface of the second of the panels;

a plurality of cooling structures formed in the panels for passing respective flows of cooling air through the panels; and wherein the cooling structures are formed to avoid both the double bend region and the stiffening rib end region.

6. The transition duct of claim 5, wherein the cooling structures comprise:

a plurality of subsurface cooling passages formed through respective ones of the plurality of the panels, each subsurface cooling passage having an inlet opening to an outside surface of the duct and an outlet opening to an inside surface of the duct; and a plurality of effusion cooling holes formed through a plurality of the panels in regions remote from the subsurface cooling passages.

7. A transition duct for conveying hot combustion gas from a combustor to a turbine in a gas turbine engine, the transition duct comprising:

a plurality of panels joined together to form a duct comprising a generally cylindrical inlet end and a generally rectangular outlet end disposed radially inwardly of the inlet end when installed in the gas turbine engine;

the outlet end comprising an outlet mouth formed to extend across at least approximately a 45° arc of a turbine inlet;

a stiffening rib end region in one of the panels proximate an end of a stiffening rib joined to an outside surface of the one of the panels;

a plurality of subsurface cooling passages formed through the one of the panels, each subsurface cooling passage having an inlet opening to an outside surface of the duct and an outlet opening to an inside surface of the duct; and wherein the cooling passages are formed to avoid the stiffening rib end region.

8. The transition duct of claim 7, further comprising:

a first portion of the subsurface cooling passages extending through the one of the panels directly under the stiffening rib remote from the stiffening rib end region; and a second portion of the subsurface cooling passages extending through the one of the panels in a direction toward the stiffening rib end region but having an axial length truncated so as not to extend proximate the stiffening rib end region.

* * * * *